US011260428B2

(12) United States Patent
Jung

(10) Patent No.: US 11,260,428 B2
(45) Date of Patent: Mar. 1, 2022

(54) CLEANING DEVICE FOR HEMMING ROLLER

(71) Applicants: HYUNDAI MOTOR COMPANY, Seoul (KR); KIA MOTORS CORPORATION, Seoul (KR)

(72) Inventor: Ki Hwan Jung, Ulsan (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 114 days.

(21) Appl. No.: 16/895,213

(22) Filed: Jun. 8, 2020

(65) Prior Publication Data

US 2021/0094078 A1 Apr. 1, 2021

(30) Foreign Application Priority Data

Sep. 26, 2019 (KR) ..... 10-2019-0118693

(51) Int. Cl.

| | |
|---|---|
| ***B08B 13/00*** | (2006.01) |
| ***B08B 1/00*** | (2006.01) |
| ***B08B 3/02*** | (2006.01) |
| *B21D 39/02* | (2006.01) |

(52) U.S. Cl.

CPC ..... *B08B 1/007* (2013.01); *B08B 1/005* (2013.01); *B08B 3/02* (2013.01); *B21D 39/023* (2013.01)

(58) Field of Classification Search

None

See application file for complete search history.

(56) References Cited

FOREIGN PATENT DOCUMENTS

JP 2012110931 A * 6/2012

OTHER PUBLICATIONS

Google Patents translation for JP2012110931 retrieved from https://patents.google.com/patent/JP2012110931A/en?oq=JP+2012110931+A on Nov. 17, 2021 (Year: 2021).*

* cited by examiner

*Primary Examiner* — Eric W Golightly

(74) *Attorney, Agent, or Firm* — Lempia Summerfield Katz LLC

(57) ABSTRACT

A cleaning device for a hemming roller cleans the hemming roller of a hemming roller unit mounted on an arm tip of a hemming robot. The cleaning device includes: a support frame installed on a floor of a workshop; a roller rotation unit that is installed on an upper surface of the support frame and rotates the hemming roller that has entered the upper surface of the support frame through the hemming robot; and a scraper that is installed to be movable back and forth on the support frame while facing the roller rotation unit and removing foreign substances on the surface of the hemming roller.

17 Claims, 11 Drawing Sheets

CLEANING DEVICE FOR HEMMING ROLLER

CROSS-REFERENCE TO RELATED APPLICATION

This application claims priority to and the benefit of Korean Patent Application No. 10-2019-0118693, filed on Sep. 26, 2019, the entire contents of which are incorporated herein by reference.

FIELD

The present disclosure relates to a cleaning device for a hemming roller. More particularly, the present disclosure relates to a cleaning device for a hemming roller that cleans the hemming roller of a hemming roller unit for hemming a vehicle body panel.

BACKGROUND

The statements in this section merely provide background information related to the present disclosure and may not constitute prior art.

In general, in a vehicle manufacturing process, body parts such as various body panels, which are press-molded through various types of press devices, are assembled, and a body in a white body (B.I.W) state is produced.

In order to mold the vehicle body panel, processes such as trimming, piercing, flanging, and hemming of the molded panel pressure-molded to a set shape are performed. And, in each process, cutting, hole processing, bending, bending, etc. are performed.

Among these, the hemming process can be divided into a hemming press method, a turn table method, and a roller hemming method using a robot. Recently, a trend of applying a roller hemming method having flexibility in response to multiple models is trend.

In the roller hemming method, the hemming roller unit is moved through the robot along the edge portions of the inner panel and the outer panel loaded on the hemming jig. Then, the flange portion of the outer panel is pressed to the tip side of the inner panel through the hemming roller of the hemming roller unit.

On the other hand, in the case of the roller hemming method using a robot, when hemming using the hemming roller unit, a hemming sealer is applied to a portion where the outer panel is folded to secure adhesion and prevent rust. However, we have discovered that when the roller is hemmed, the hemming sealer inside the panel flows out by pressure of the hemming roller, causing contamination of the hemming roller.

The contamination of the hemming roller acts as a factor that causes contamination of the vehicle body panel and bending of the vehicle body panel. Accordingly, we have found that a periodic cleaning operation is desired to remove the contaminants of the hemming roller.

The above information disclosed in this Background section is only for enhancement of understanding of the background of the present disclosure and therefore it may contain information that does not form the prior art that is already known to a person of ordinary skill in the art.

SUMMARY

The present disclosure provides a cleaning device for hemming roller that can automatically clean the foreign matter on the hemming roller with a simple configuration.

In one form of the present disclosure, a cleaning device for a hemming roller cleans the hemming roller of the hemming roller unit mounted on an arm tip of the hemming robot, and the cleaning device includes: a support frame installed on a floor of a workshop in a vertical direction; a roller rotation unit that is installed on an upper surface of the support frame and rotates the hemming roller that has entered the upper surface of the support frame through the hemming robot; and a scraper that is installed on the support frame and moves back and forth, while facing the roller rotation unit and removing foreign substances on a surface of the hemming roller.

In one form, the cleaning device may further include: a felt cushion that is installed on the upper surface of the support frame to be moved back and forth between the roller rotation unit and the scraper, and removes a residual foreign matter on the surface of the hemming roller.

In another form, the cleaning device may further include a cleaning oil spraying unit for spraying cleaning oil to the scraper and felt cushion side, respectively.

In other form, the cleaning device may further include a cleaning oil receiving portion installed on the upper surface of the support frame and collecting cleaning oil sprayed to the scraper and felt cushion.

In some forms of the present disclosure, the roller rotation unit may include: a servo motor as a first drive unit fixedly installed on the upper surface of the support frame, and a rotation member installed to be connected to a drive shaft of the servo motor, and rotating in contact with the bottom surface of the hemming roller.

In some forms of the present disclosure, the rotation member may be is provided with a rubber roller that causes friction to the bottom surface of the hemming roller and rotates the hemming roller.

In some forms of the present disclosure, the cleaning device e may further include a first drive cylinder fixedly installed on the support frame and serving as a second drive unit for applying a forward and backward operation force to the scraper.

In some forms of the present disclosure, the cleaning device may further include a second drive cylinder fixedly installed on the support frame and serving as a third drive unit that applies a forward and backward operating force to the felt cushion.

In some forms of the present disclosure, the scrapper may have a scraping surface that is in close contact with the roller surface of the hemming roller, and is installed at a front end of a working rod of the first drive cylinder through a bracket.

In some forms of the present disclosure, the felt cushion may have a cushion surface in close contact with the upper roller surface and the lower roller surface of the hemming roller, and is installed at the front end of the working rod of the second drive cylinder through a bracket.

In some forms of the present disclosure, the cleaning oil spraying unit may include a cleaning oil storage tank installed on the support frame, a cleaning oil supply pump which is connected to the cleaning oil storage tank and discharges cleaning oil stored in the cleaning oil storage tank through a nozzle line, and a nozzle member fixed to each of the scraper and felt cushion, connected to the nozzle line, and spraying cleaning oil to the scraper and felt cushion.

In another form of the present disclosure, a cleaning device for a hemming roller, which has a plurality of preliminary hemming rollers and a main hemming roller, cleans the main hemming roller while the hemming roller unit mounted on an arm tip of the hemming robot is moved to a predetermined position through the hemming robot. The cleaning device includes: a support frame installed on a floor of a workshop in a vertical direction; a roller detection sensor that is installed on the support frame and detects a presence or ab absence of a preliminary hemming roller of the plurality of preliminary hemming rollers and the main hemming roller when the hemming roller unit moves to a predetermined position by the hemming robot; a roller rotation unit that is installed on an upper surface of the support frame and rotates the main hemming roller through a first drive unit; a scraper that is installed on the support frame and moves back and forth while facing the roller rotation unit through a second drive unit, in close contact with the roller surface of the main hemming roller, and removing foreign substances on the roller surface; a felt cushion installed on the upper surface of the support frame to be moved back and forth between the roller rotation unit and the scraper through a third drive unit and removing residual foreign substances on the roller surface of the hemming roller; and a cleaning oil spraying unit for spraying cleaning oil to the scraper and felt cushion, respectively.

In some forms of the present disclosure, in the cleaning device for hemming roller, the roller detection sensor may include a sensor body installed on a sensor bracket provided on an upper surface of the support frame, a switch lever rotatably installed in the vertical direction through a spring on the sensor body, and a touch roller rotatably installed at an end of the switch lever and in contact with the main hemming roller and rotating.

In some forms of the present disclosure, the cleaning device for hemming roller may further include a cleaning oil receiving portion installed on an upper surface of the support frame and collecting cleaning oil sprayed to the scraper and felt cushion side.

In some forms of the present disclosure, in the cleaning device for hemming roller, the scrapper may be provided with a steel block having a scraping surface contacting the roller surface of the main hemming roller.

In some forms of the present disclosure, in the cleaning device for hemming roller, the felt cushion may be made of a woolen fiber having a cushion surface in close contact with an upper roller surface and a lower roller surface of the hemming roller.

In the forms of the present disclosure, as the main hemming roller having a relatively high degree of contamination is automatically cleaned as a low-cost facility having a simple configuration, it is possible to reduce investment cost and shorten cycle time.

In addition, effects obtained or predicted due to forms of the present disclosure will be disclosed directly or implicitly in the detailed description of the forms of the present disclosure. That is, various effects predicted according to forms of the present disclosure will be disclosed within a detailed description to be described later.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
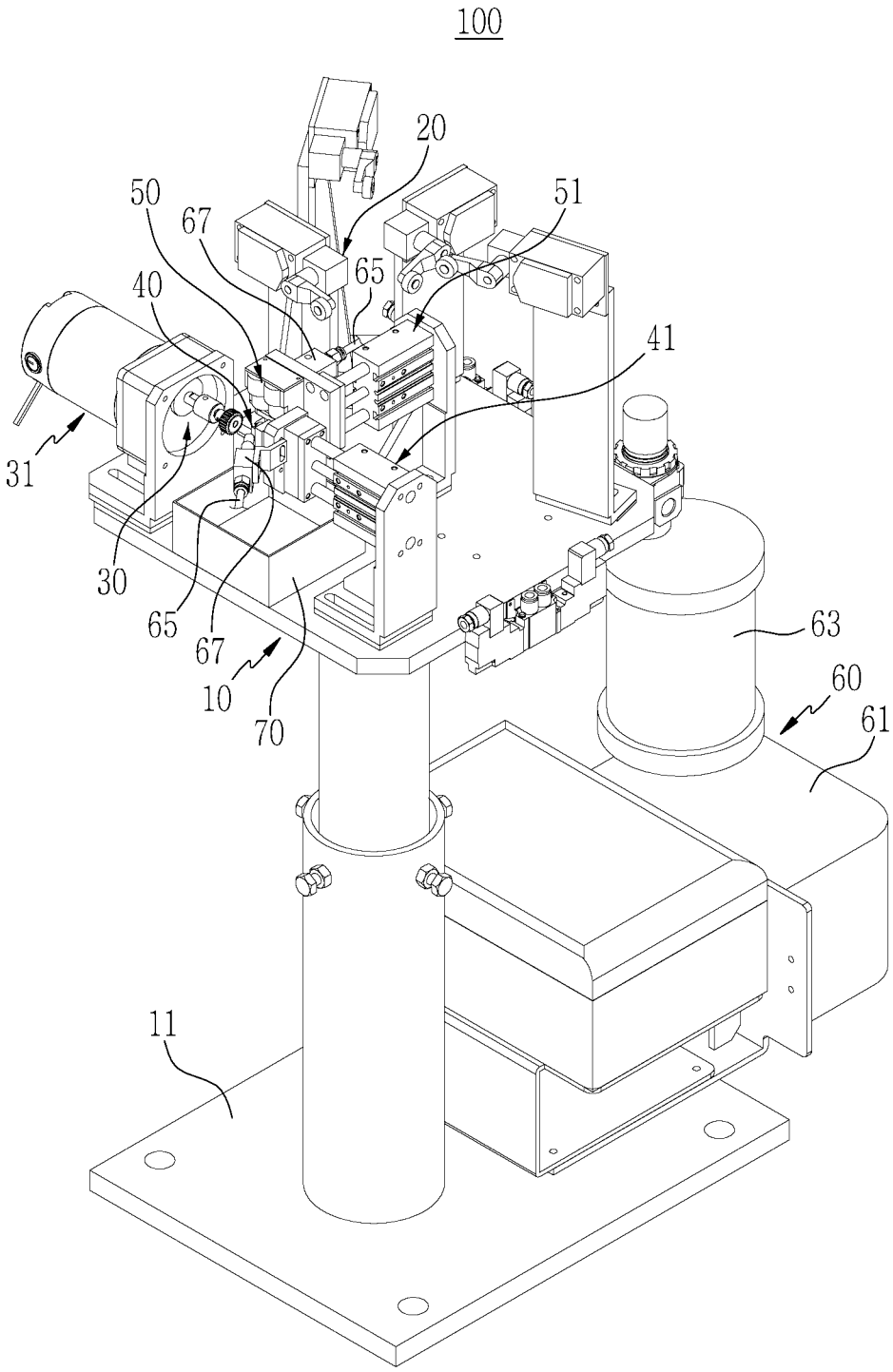
FIG. 1 is a perspective view showing a cleaning device for a hemming roller according to an exemplary form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure will be described more fully hereinafter with reference to the accompanying drawings, in which exemplary forms of the present disclosure are shown. As those skilled in the art would realize, the described forms may be modified in various different ways, all without departing from the spirit or scope of the present disclosure.

Since these drawings are for reference to specifically and clearly describe exemplary forms of the present disclosure and technical ideas or features, it is revealed in advance that the drawings may be different from actual product specifications.

The size and thickness of each element are arbitrarily shown in the drawings, and the present disclosure is not necessarily limited thereto, and in the drawings, the thickness of layers, films, panels, regions, etc., are exaggerated for clarity.

Further, in the following detailed description, names of constituents, which are in the same relationship, are divided into "the first", "the second", and the like, but the present disclosure is not limited to the order in the following description.

In the specification, unless explicitly described to the contrary, the word "comprise" and variations such as "comprises" or "comprising", will be understood to imply the inclusion of stated elements but not the exclusion of any other elements.

In addition, the terminology such as " . . . unit", " . . . means", " . . . part", or " . . . member", which is disclosed in the specification, refers to a unit of an inclusive constituent which performs at least one of the functions or operations.

Figure 2:
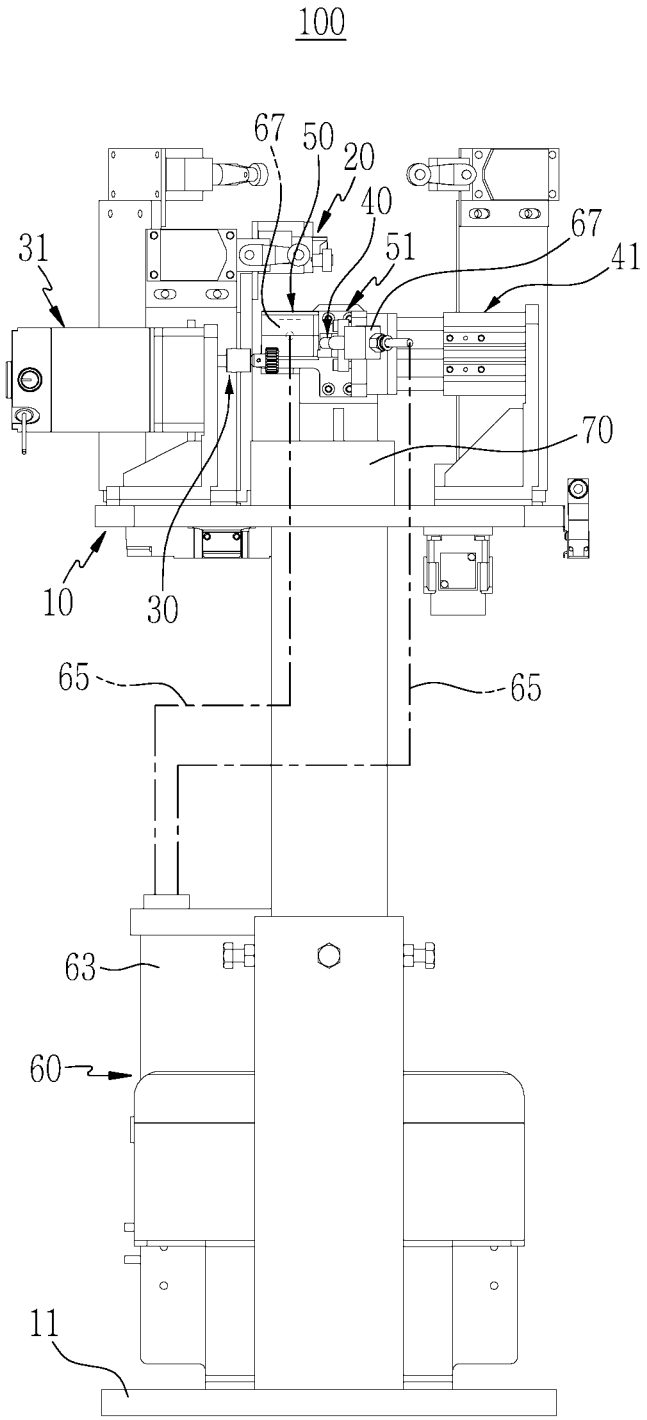
FIG. 2 is a front configuration diagram showing a cleaning device for a hemming roller according to an exemplary form of the present disclosure.

FIG. 1 is a perspective view showing a cleaning device for a hemming roller according to an exemplary form of the present disclosure, and FIG. 2 is a front configuration diagram showing a cleaning device for a hemming roller according to an exemplary form of the present disclosure.

Referring to FIG. 1 and FIG. 2, the cleaning device 100 for a hemming roller may be applied to a process of forming a vehicle body panel such as a door, a hood, a trunk lid, a tail gate, a wheel arch, and a fender in a vehicle body assembly plant.

Furthermore, the cleaning device 100 for a hemming roller according to an exemplary form of the present disclosure may be applied to a roller hemming system that folds an edge end of a vehicle body panel in a roller hemming method using a hemming robot.

Figure 3:
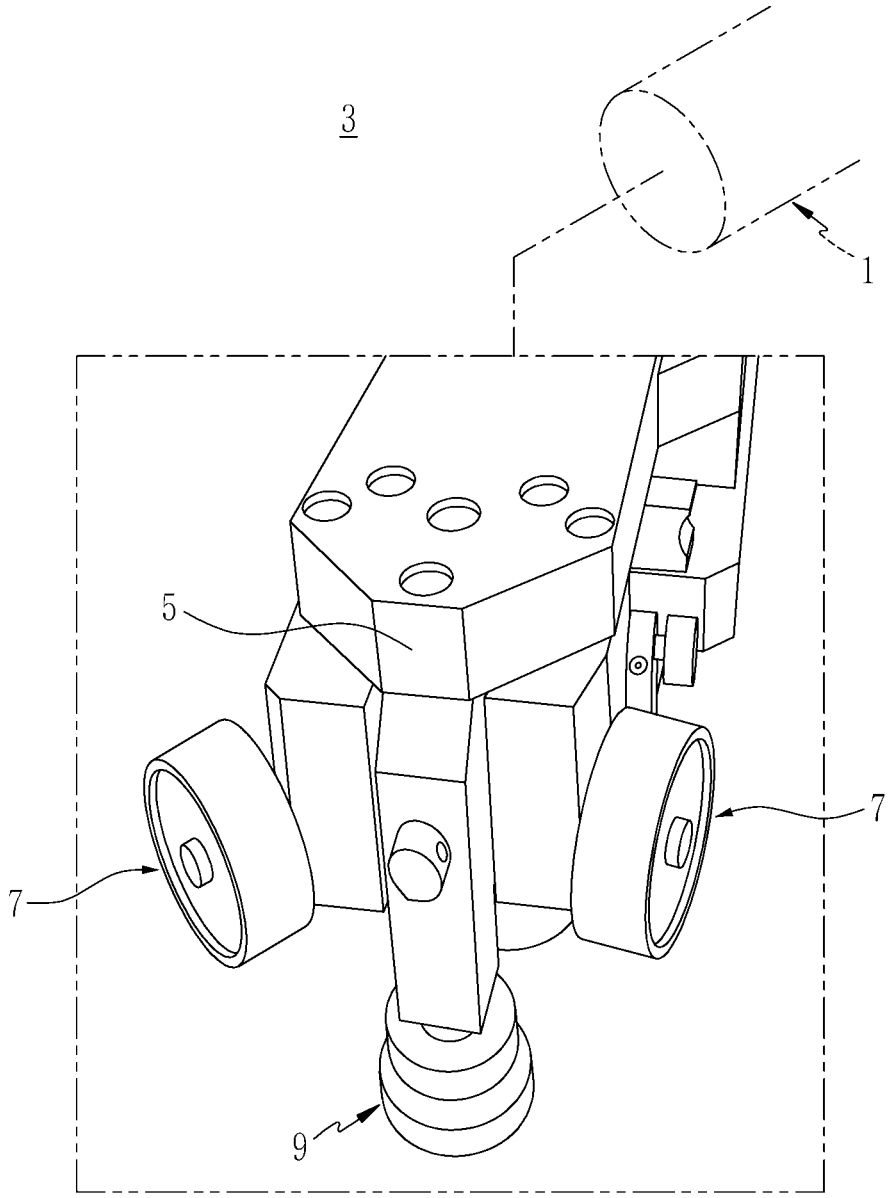
FIG. 3 is a view showing an example of a hemming roller unit for cleaning the hemming roller using the cleaning device for the hemming roller in one form of the present disclosure.

In one form, the roller hemming system includes a hemming roller unit 3 as shown in FIG. 3. The hemming roller unit 3 moves along the edge portion of the outer panel and the inner panel through the hemming robot 1, and can be joined by folding the flange portion of the outer panel to the tip of the inner panel.

The hemming roller unit 3 is mounted on the front end of the arm of the hemming robot 1 and can be moved to a set position through the hemming robot 1. The hemming roller unit 3 includes a plurality of preliminary hemming rollers 7 rotatably installed on the tool body 5 and a single main hemming roller 9.

Here, the preliminary hemming rollers 7 are rollers that sequentially bend and form the flange portion of the outer panel at a certain angle. The main hemming roller 9 is also commonly referred to as a "curl roller" in the art, and is a roller that completely presses and forms a flange portion.

The hemming roller unit 3 has a configuration of a hemming roller assembly for a roller hemming system widely known in the art, and thus a detailed description of the configuration will be omitted herein.

In addition, the scope of protection of the present disclosure should not be understood as being limited to hemming body parts such as body panels, and if the metal panel parts applied to structures of various types and uses are hemmed, the technical idea of the present disclosure This can be applied.

The cleaning device 100 for the hemming roller according to an exemplary form of the present disclosure is for cleaning the main hemming roller 9 having the highest degree of contamination by foreign substances such as sealers with the hemming roller unit 3 moved to the set position through the hemming robot 1.

Hereinafter, the components of the cleaning device 100 will be described based on the hemming roller unit 3 being positioned in the vertical direction. Here, an upper part or an upper portion is defined based on the drawings. The lower-facing portion, or lower portion will be defined based on the drawings.

However, the definition of the above direction is a relative meaning, and since the direction may vary depending on the reference position of the hemming roller unit 3, the above-described reference direction is not necessarily limited to the reference direction of the present disclosure.

Furthermore, the "stage (one side/one side or the other side/one side)" in the following may be defined as either end, and a certain part (the one side/one side or the other side/one side) including the end).

The cleaning device 100 is made of a structure capable of automatically cleaning the foreign matter on the main hemming roller 9 with a simple configuration.

Referring to FIG. 1 to FIG. 3, the cleaning device 100 for a hemming roller may include: the support frame 10, the roller detection sensors 20, the roller rotation unit 30, the scraper (40), a felt cushion 50, a cleaning oil spraying unit 60 and a cleaning oil receiving portion 70.

In an exemplary form of the present disclosure, the support frame 10 is for supporting various components to be further described below, and is installed in the vertical direction on the floor of the workshop. The support frame 10 may be composed of one frame or two or more frames connected to each other.

For example, the support frame 10 includes a base frame 11 fixed to the floor of the workshop. The support frame 10 may be made of a structure capable of adjusting the height of the base frame 11.

Furthermore, the support frame 10 may include various accessory elements such as brackets, bars, rods, plates, blocks, ribs, and collars for supporting various components.

However, the above-mentioned accessory elements are for installing the respective components, which will be further described below, on the support frame 10. Therefore, in the exemplary form of the present disclosure, except for exceptional cases, the aforementioned accessory elements are collectively referred to as a support frame 10.

In an exemplary form of the present disclosure, the roller sensing sensor 20 is for detecting the presence or absence of the preliminary hemming rollers 7 and the main hemming roller 9 of the hemming roller unit 3 when the hemming roller unit 3 is moved by the hemming robot 1 to a set position (i.e., a predetermined position).

That is, the roller detection sensor 20 may detect the fall or damage of the preliminary hemming rollers 7 and the main hemming roller 9 due to external force. The roller sensing sensor 20 is installed on the upper surface of the support frame 10 to detect the respective preliminary hemming rollers 7 and the main hemming roller 9.

Figure 4:
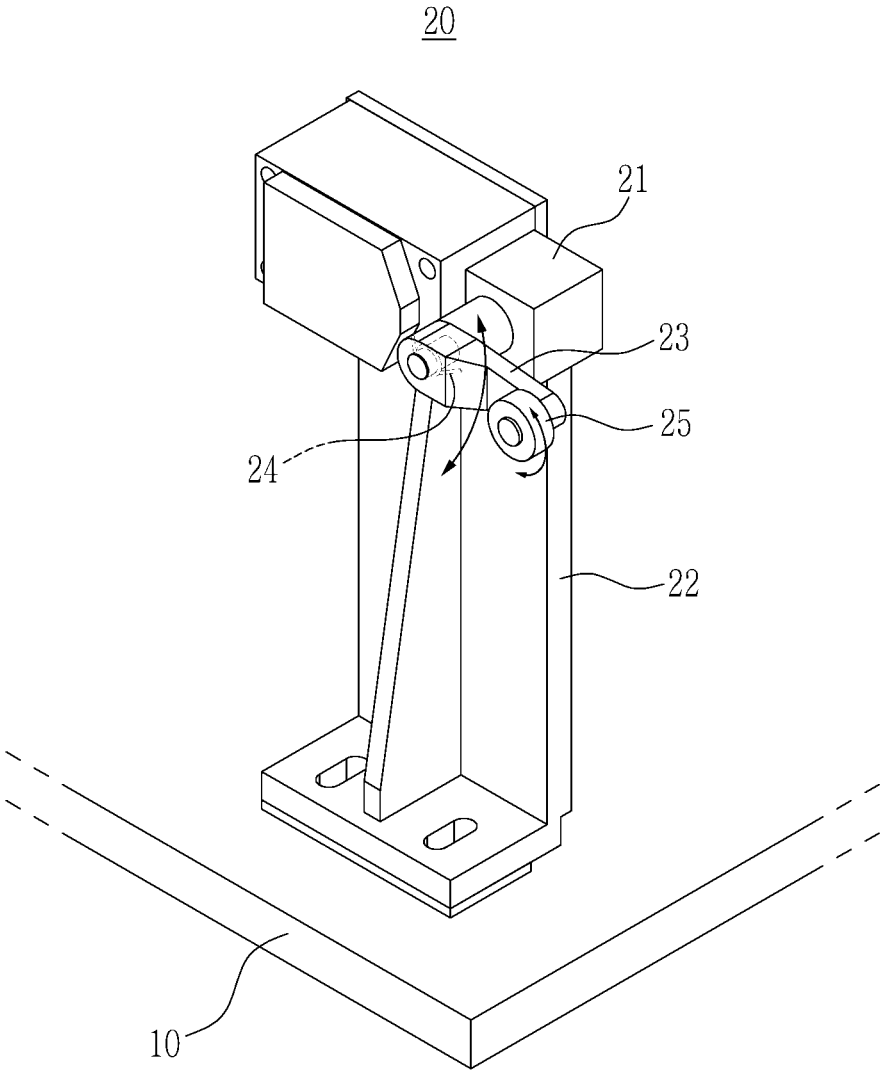
FIG. 4 is a view showing a roller detection sensor applied to the cleaning device for the hemming roller according to an exemplary form of the present disclosure.

FIG. 4 is a view showing a roller detection sensor applied to the cleaning device for a hemming roller according to an exemplary form of the present disclosure.

Referring to FIG. 4, in an exemplary form of the present disclosure, the roller detection sensor 20 includes a sensor body 21, a switch lever 23 and a touch roller 25.

The sensor body 21 is installed on the sensor bracket 22 provided on the upper surface of the support frame 10 (see FIG. 1). The switch lever 23 is rotatably installed in the vertical direction through the spring 24 on the sensor body 21. The spring 24 may include a torsion spring.

In addition, the touch roller 25 is installed to be freely rotatable at the end of the switch lever 23. The touch roller 25 may be rotated in contact with the preliminary hemming rollers 7 and the main hemming roller 9, respectively.

Here, when the hemming roller unit 3 is moved downward from the upper side of the support frame 10 through the hemming robot (see FIG. 1), the preliminary hemming rollers 7 and the main hemming roller 9 rotate the touch roller 25 while being in contact with the touch roller 25. Then, the switch lever 23 is rotated in the downward direction.

In this case, the switch lever 23 rotates in the downward direction, and accordingly, a switch (not shown in the drawing) of the sensor body 21 is brought into contact with a set circuit such that a contact signal is output to a controller (not shown in the drawing).

Referring to FIG. 1 FIG. 3, in an exemplary form of the present disclosure, the roller rotation unit 30 is for rotating the main hemming roller 9 through the first drive unit 31 at a set position on the support frame 10. The roller rotation unit 30 is installed on one side of the upper surface of the support frame 10.

Figure 5:
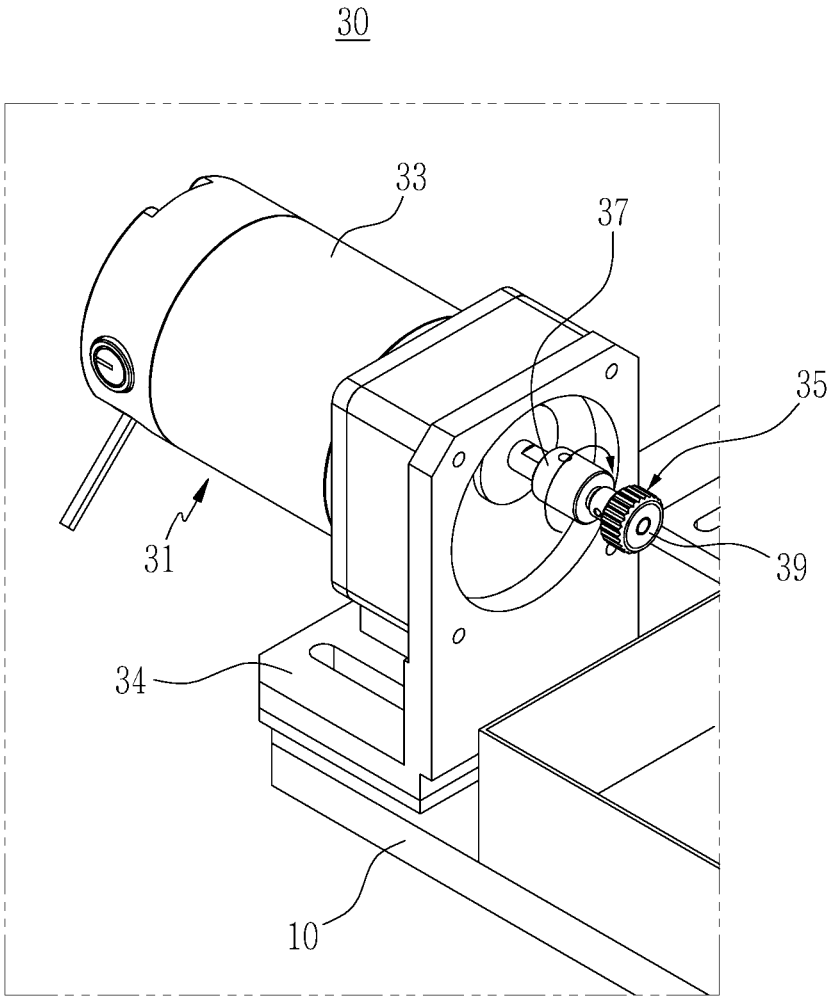
FIG. 5 is a view showing a roller rotation unit applied to the cleaning device for the hemming roller according to an exemplary form of the present disclosure.

FIG. 5 is a view showing a roller rotation unit applied to the cleaning device for a hemming roller according to an exemplary form of the present disclosure.

Referring to FIG. 5, in an exemplary form of the present disclosure, the roller rotation unit 30 includes a servo motor 33 as a first drive unit 31 and a rotation member 35 installed to be connected to the servo motor 33.

The servo motor 33 is provided as a drive motor of a known technology capable of performing a servo control of the rotation direction and rotation speed, and is mounted on one side of the upper surface of the support frame 10 through the mounting bracket 34.

The rotation member 35 is rotated while being in contact with the bottom surface of the main hemming roller 9, and is installed to be connected to the drive shaft 37 of the servo motor 33. Here, the rotation member 35 may be provided with a rubber roller 39 that applies frictional force to the bottom surface of the main hemming roller 9 and rotates the main hemming roller 9.

Referring to FIG. 1 FIG. 3, in an exemplary form of the present disclosure, the scraper 40 is in close contact with the roller surface of the main hemming roller 9 and is intended to remove (scrape) foreign matter (e.g., sealer, anti-spatter oil, etc.) from the roller surface.

The scraper 40 is installed on the other side of the upper surface of the support frame 10. The scraper 40 is installed to be movable back and forth by the second drive unit 41 while facing the roller rotation unit 30.

Figure 6:
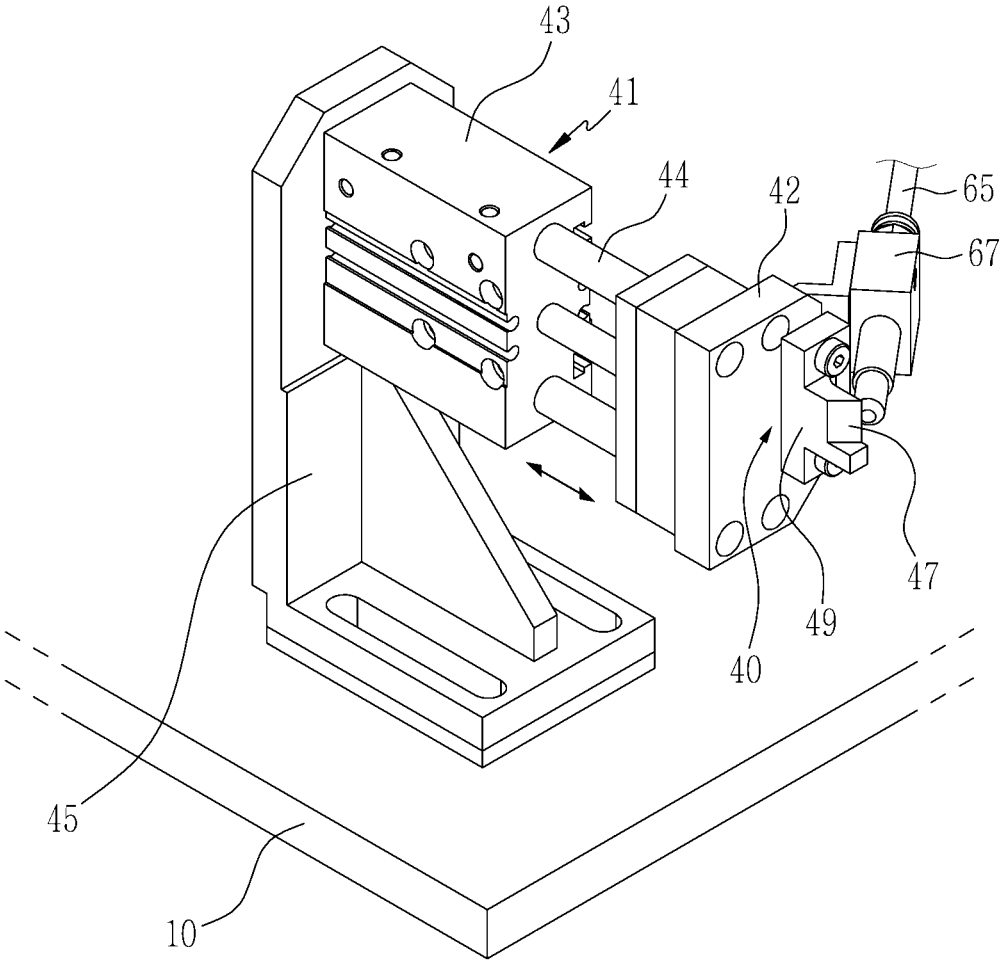
FIG. 6 is a view showing a scraper applied to the cleaning device for the hemming roller according to an exemplary form of the present disclosure.

FIG. 6 is a view showing a scraper applied to the cleaning device for a hemming roller according to an exemplary form of the present disclosure.

Referring to FIG. 6, in the exemplary form of the present disclosure, the scraper 40 is installed to be connected to the first drive cylinder 43 as the second drive unit 41. The first drive cylinder 43 is applied to the scraper 40 to move forward and backward, and is fixedly installed on the upper surface of the support frame 10 through the mounting bracket 45.

Here, the scraper 40 is provided with a steel block 49 having a scraping surface 47 contacting (adhering to) the roller surface of the main hemming roller 9. Then, the scraper 40 is installed to be fixed to the front end of the working rod 44 of the first drive cylinder 43 through the fixing bracket 42.

Referring to FIG. 1 to FIG. 3, in an exemplary form of the present disclosure, the felt cushion 50 is for cleaning the surface of the main hemming roller 9 primarily through the scraper 40, for removing residual foreign matter on the surface of the main hemming roller 9.

The felt cushion 50 is installed on the upper surface of the support frame 10. The felt cushion 50 is installed to be moved back and forth by the third drive unit 51 toward the roller rotation unit 30 and the scraper 40.

Figure 7:
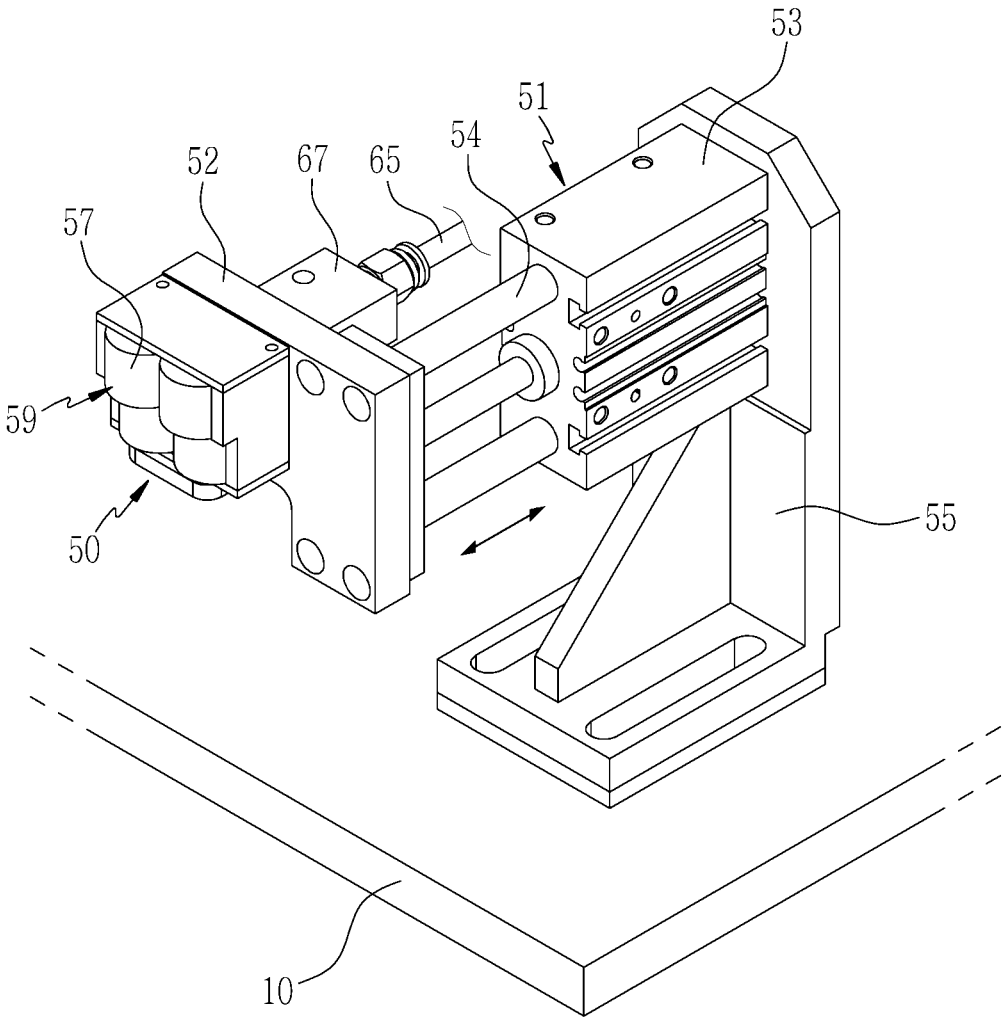
FIG. 7 is a view showing a felt cushion applied to the cleaning device for the hemming roller according to an exemplary form of the present disclosure.

FIG. 7 is a view showing a felt cushion applied to the cleaning device for a hemming roller according to an exemplary form of the present disclosure.

Referring to FIG. 7, in the exemplary form of the present disclosure, the felt cushion 50 is installed to be connected to the second drive cylinder 53 as the third drive unit 51. The second drive cylinder 53 is applied to the felt cushion 50 to move forward and backward, and is fixedly installed on the upper surface of the support frame 10 through the mounting bracket 55.

Here, the felt cushion 50 is a bar made of a felt material having a cushion, and the cushion surface 57 in close contact with the upper roller surface and the lower roller surface of the main hemming roller 9 has a block-shaped woolen fiber 59. The felt cushion 50 is provided in plural, and is fixedly installed at the front end of the working rod 54 of the second drive cylinder 53 through the fixing bracket 52.

Referring to FIG. 1 to FIG. 3, in the exemplary form of the present disclosure, the cleaning oil spraying unit 60 is for spraying cleaning oil to the scraper 40 and the felt cushion 50, which are in close contact with the roller surface of the main hemming roller 9, respectively.

The cleaning oil spraying unit 60 includes a cleaning oil storage tank 61, a cleaning oil supply pump 63 and a nozzle member 67.

The cleaning oil storage tank 61 stores conventional cleaning oil, for example, oil for removing foreign substances on a metal surface, and is installed under the support frame 10. The cleaning oil supply pump 63 is connected to the cleaning oil storage tank 61 and is fixedly installed on the support frame 10.

In the above, the washing oil supply pump 63 is a known oil pump, and the washing oil stored in the washing oil storage tank 61 may be discharged through the nozzle line 65 as a set pumping pressure.

In addition, the nozzle member 67 is provided in the form of a spray gun for spraying cleaning oil into the scraper 40 and the felt cushion 50, respectively. The nozzle member 67 is connected to the cleaning oil supply pump 63 through the nozzle line 65, and is fixed to the scraper 40 and the felt cushion 50, respectively.

Here, the nozzle member 67 may be installed to be fixed to each of the scraper 40 and the fixed bracket 52 on the side of the felt cushion 50 through separate brackets (see FIGS. 6 and 7).

Furthermore, each nozzle member 67 simultaneously or alternately sprays cleaning oil to the scraper 40 and the felt cushion 50 through a valve (not shown in the drawing) provided in the nozzle line 65.

Referring to FIG. 1 to FIG. 3, in an exemplary form of the present disclosure, the cleaning oil receiving portion 70 captures the cleaning oil cleaning the roller surface while being sprayed toward the scraper 40 and the felt cushion 50 in close contact with the roller surface of the main hemming roller 9.

The cleaning oil receiving portion 70 is provided in a case shape with an open top, and is fixedly installed on the upper surface of the support frame 10 at the lower side of the roller rotation unit 30.

Hereinafter, the operation of the cleaning device 100 for a hemming roller configured as described above will be described in detail with reference to the drawings and the accompanying drawings.

FIG. 8 to FIG. 11 are views for explaining the operation of the cleaning device for a hemming roller according to an exemplary form of the present disclosure.

First, in the exemplary form of the present disclosure, as in the drawings disclosed above, in a state in which hemming of the vehicle body panel through a hemming roller unit 3 mounted on the hemming robot 1 for a certain time, the hemming roller unit 3 is moved through the hemming robot 1 to a set position on the support frame 10.

In this process, in the exemplary form of the present disclosure, the presence or absence of the preliminary hemming rollers 7 and the main hemming roller 9 of the hemming roller unit 3 are detected through the roller detection sensors 20, and the detection signal is controlled by the controller (Not shown in the drawing).

Specifically, in an exemplary form of the present disclosure, the hemming roller unit 3 is moved in the downward direction through the hemming robot 1 from the upper side of the support frame 10.

Then, the preliminary hemming rollers 7 and the main hemming roller 9 are in contact with the touch rollers 25 of the roller detection sensors 20 to rotate the touch rollers 25 and lower the switch lever 23 rotate in the direction.

Thus, as the switch lever 23 rotates in the downward direction, in an exemplary form of the present disclosure, the switch (not shown in the drawing) inside the sensor body 21 is contacted to the set circuit through the switch lever 23. The contact signal is output to the controller.

Therefore, in an exemplary form of the present disclosure, it is possible to detect whether the preliminary hemming rollers 7 and the main hemming roller 9 are missing or damaged due to external force through the roller sensing sensors 20.

Figure 8:
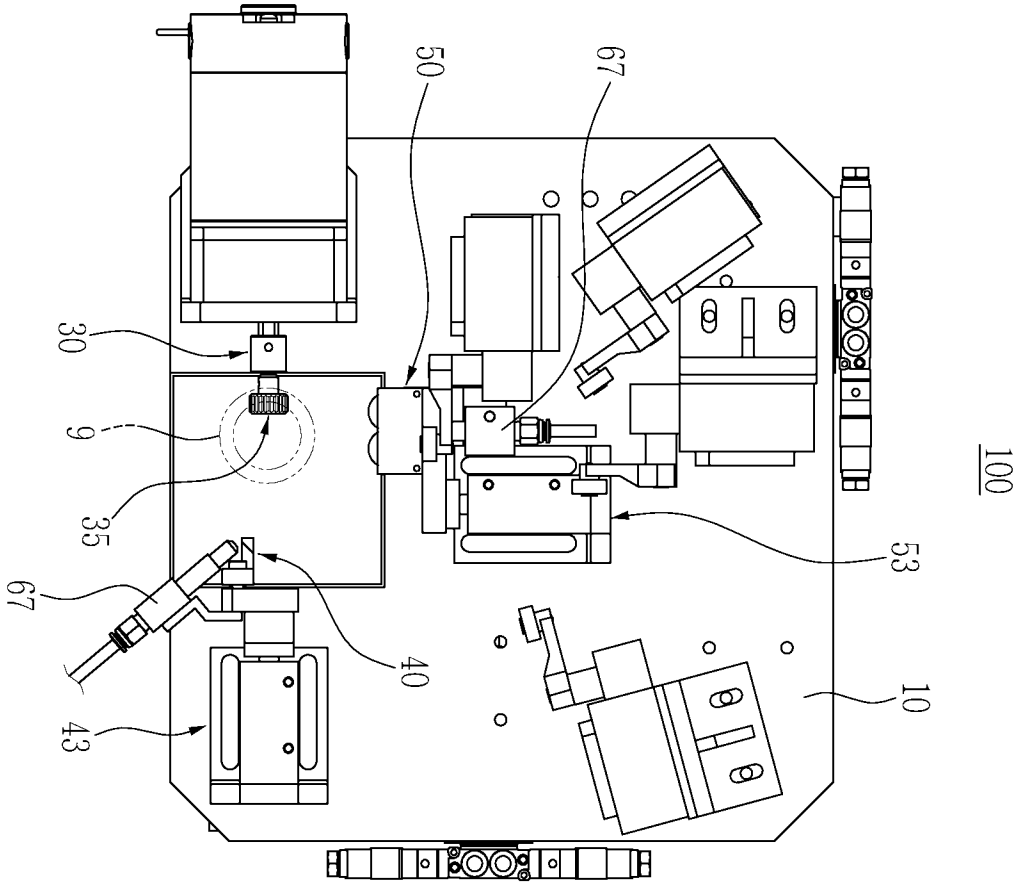
FIG. 8 to FIG. 11 are views for explaining the operation of the cleaning device for the hemming roller according to an exemplary form of the present disclosure.

Next, in the exemplary form of the present disclosure, as shown in FIG. 8, the hemming roller unit 3 is moved through the hemming robot 1 toward the roller rotation unit 30 side. Then, the main hemming roller 9 of the hemming roller unit 3 is brought into close contact with the rotation member 35 of the roller rotation unit 30.

Here, the scraper 40 is in a retracted state with the nozzle member 67 due to the reverse operation of the first drive cylinder 43. And, the felt cushion 50 is also in a retracted state with the nozzle member 67 due to the reverse operation of the second drive cylinder 53.

Figure 9:
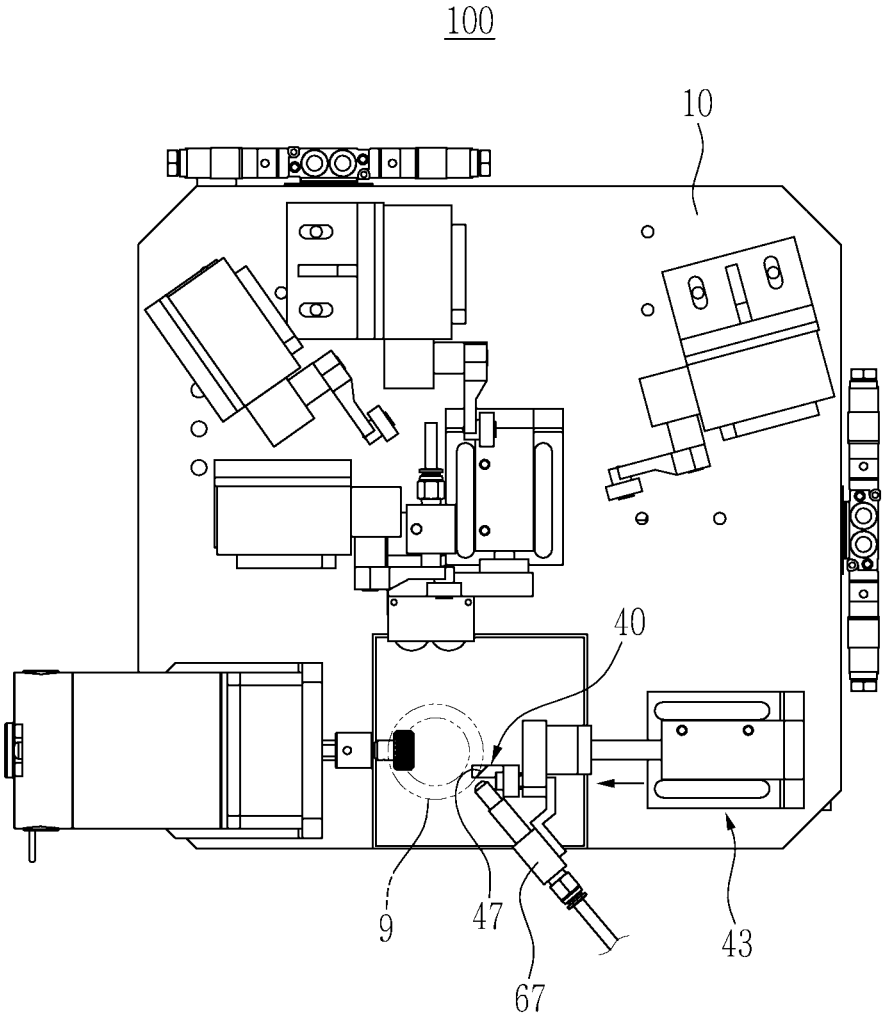

In this state, in the exemplary form of the present disclosure, as shown in FIG. 9, the scraper 40 is moved forward by the forward operation of the first drive cylinder 43, and the scraping surface 47 of the scraper 40 is moved. The main hemming roller 9 is brought into contact (adhered) to the roller surface. At this time, the nozzle member 67 is moved to the main hemming roller 9 side with the scraper 40.

Figure 10:
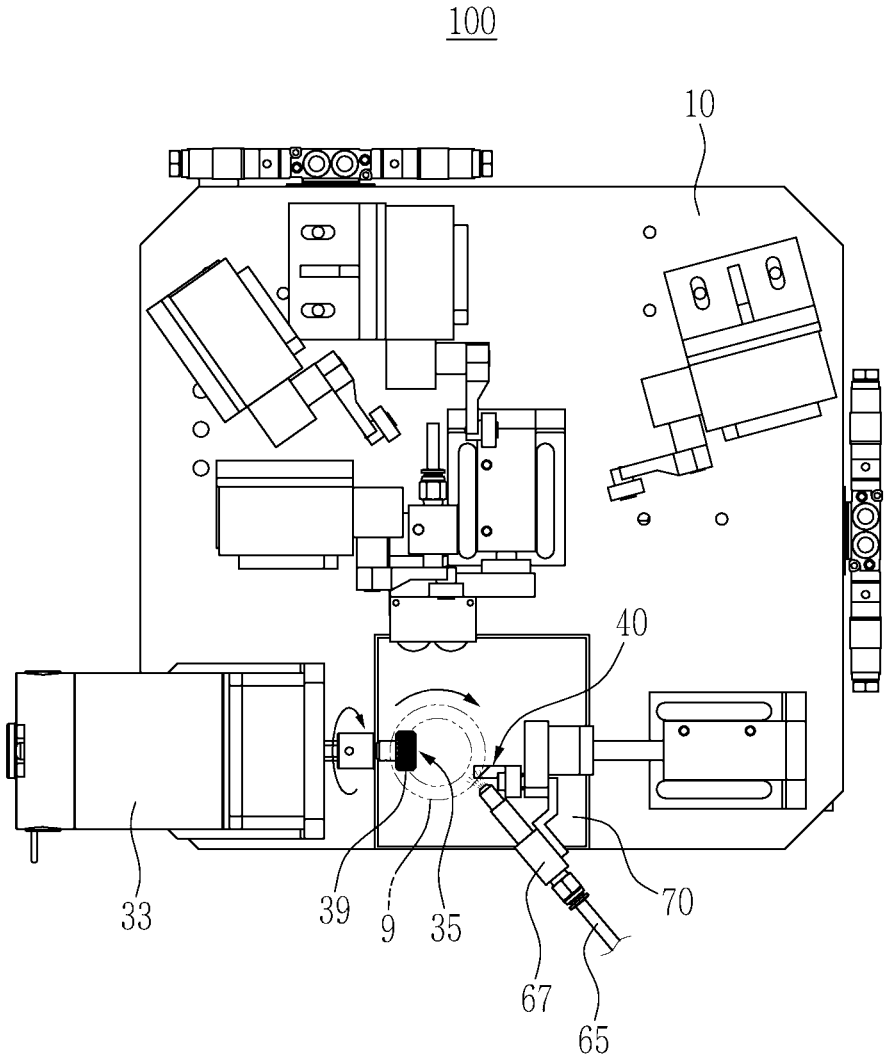

Then, in the exemplary form of the present disclosure, as shown in FIG. 10, the servo motor 33 is driven, and the rotation member 35 is rotated. Accordingly, the rotation member 35 applies frictional force to the bottom surface of the main hemming roller 9 through the rubber roller 39, and rotates the main hemming roller 9.

At the same time, in the exemplary form of the present disclosure, the cleaning member supply pump 63 is driven, and the cleaning member stored in the cleaning oil storage tank 61 is discharged through the nozzle line 65 while the nozzle member 67 on the scraper 40 side. Then, the cleaning oil is sprayed to the scraper 40 through the nozzle member 67.

Therefore, in the exemplary form of the present disclosure, the foreign matter on the roller surface of the main hemming roller 9 is removed through the scraper 40, and the roller surface of the main hemming roller 9 is cleaned by using cleaning oil. In this process, the cleaning oil that is cleaned through the nozzle member 67 to the scraper 40 side and cleans the roller surface of the main hemming roller 9 is collected by the cleaning oil receiving portion 70.

Figure 11:
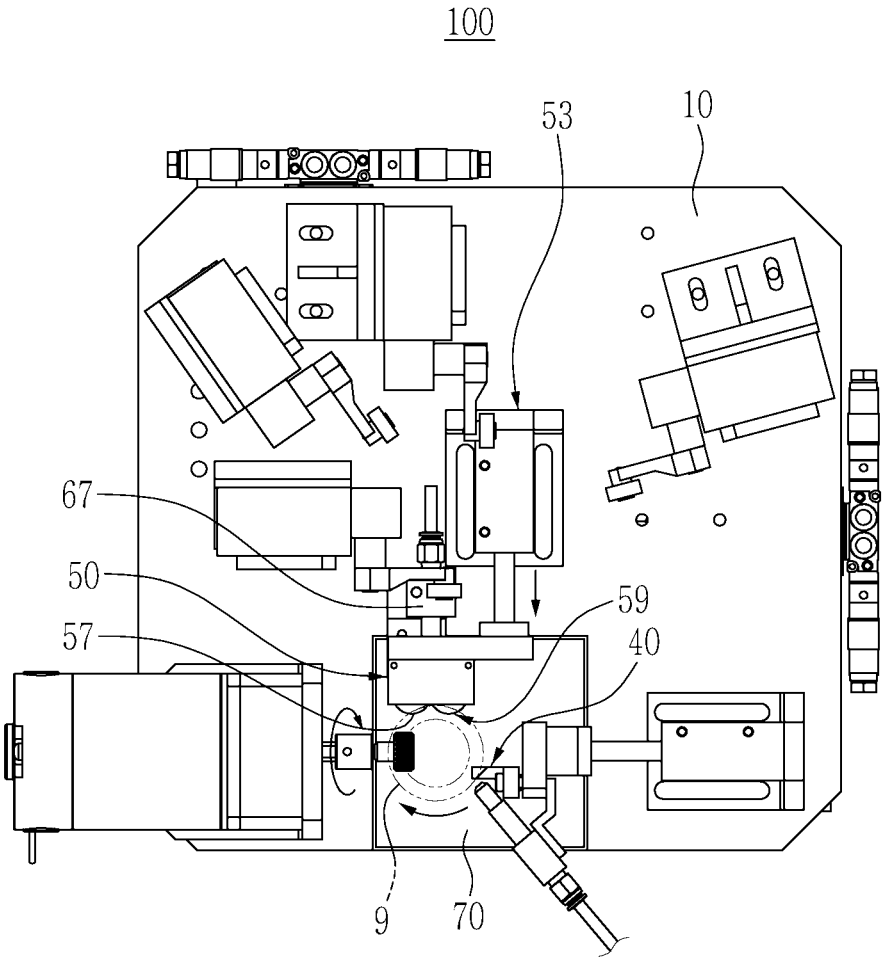

Next, in the exemplary form of the present disclosure in the process of cleaning the main hemming roller 9 through the scraper 40, as shown in FIG. 11, the felt cushion 50 is moved forward by the forward operation of the second drive cylinder 53. At this time, the nozzle member 67 is moved to the side of the main hemming roller 9 together with the felt cushion 50.

Accordingly, in the exemplary form of the present disclosure, the cushion surface 57 of the felt cushion 50 is brought into close contact with the upper roller surface and the lower roller surface of the main hemming roller 9. Then, residual foreign matter on the surface of the main hemming roller 9 is removed through the hair fibers 59.

In the exemplary form of the present disclosure in the above process, the cleaning oil is sprayed to the felt cushion 50 through the nozzle member 67. Then, in the exemplary form of the present disclosure, the residual foreign matter on the roller surface of the main hemming roller 9 may be removed through the felt cushion 50 through the cleaning oil. At this time, while washing the felt cushion 50 through the nozzle member 67 toward the side of the main hemming roller 9, the cleaning oil is collected by the cleaning oil receiving portion 70.

In the exemplary form of the present disclosure as described so far, as the main hemming roller 9 having a relatively high degree of contamination is automatically cleaned as a low-cost facility with a simple configuration, it is possible to reduce investment cost and shorten cycle time.

While this present disclosure has been described in connection with what is presently considered to be practical exemplary forms, it is to be understood that the present disclosure is not limited to the disclosed forms. On the contrary, it is intended to cover various modifications and equivalent arrangements included within the spirit and scope of the present disclosure.

<Description of symbols>

| | |
|---|---|
| 1: hemming robot | 3: hemming roller unit |
| 5: tool body | 7: preliminary hemming roller |
| 9: main hemming roller | 10: support frame |
| 11: base frame | 20: roller detection sensor |
| 21: sensor body | 22: sensor bracket |
| 23: switch lever | 24: spring |
| 25: touch roller | 30: roller rotation unit |
| 31: first drive unit | 33: servo motor |
| 34, 45, 55: mounting bracket | 35: rotation member |
| 37: drive shaft | 39: rubber roller |
| 40: scrapper | 41: second drive unit |
| 42, 52: fixing bracket | 43: first drive cylinder |
| 44, 54: operation rod | 47: scrapping surface |
| 49: steel block | 50: felt cushion |
| 51: third drive unit | 53: second drive cylinder |
| 57: cushion surface | 59: woolen fiber |
| 60: cleaning oil spraying unit | 61: cleaning oil storage tank |
| 63: cleaning oil supply pump | 65: nozzle line |
| 67: nozzle member | 70: cleaning oil receiving portion |
| 100: cleaning device for hemming roller | |

What is claimed is:

1. A cleaning device for cleaning a hemming roller of a hemming roller unit mounted on an arm tip of a hemming robot, the cleaning device comprising:

a support frame installed on a floor of a workshop in a vertical direction;

a roller rotation unit installed on an upper surface of the support frame and configured to rotate the hemming roller, wherein the hemming roller has entered the upper surface of the support frame through the hemming robot; and a scraper installed on the support frame and configured to:

move back and forth while facing the roller rotation unit, and remove foreign substances on a surface of the hemming roller.

2. The cleaning device of claim 1, further comprising:

a felt cushion installed on the upper surface of the support frame and configured to: move back and forth between the roller rotation unit and the scraper, and remove a residual foreign matter on the surface of the hemming roller.

3. The cleaning device of claim 2, further comprising:

a cleaning oil spraying unit configured to spray cleaning oil toward the scraper and the felt cushion, respectively.

4. The cleaning device of claim 3, further comprising:

a cleaning oil receiving portion installed on the upper surface of the support frame and configured to collect the cleaning oil sprayed toward the scraper and the felt cushion.

5. The cleaning device of claim 3, wherein the cleaning oil spraying unit includes:

a cleaning oil storage tank installed on the support frame, a cleaning oil supply pump connected to the cleaning oil storage tank and configured to discharge cleaning oil stored in the cleaning oil storage tank through a nozzle line, and a nozzle member fixed to each of the scraper and felt cushion, connected to the nozzle line and configured to spray the cleaning oil to the scraper and the felt cushion.

6. The cleaning device of claim 2, further comprising:

a drive cylinder fixedly installed on the support frame and configured to apply a forward and backward operating force to the felt cushion.

7. The cleaning device of claim 6, wherein the felt cushion has a cushion surface in close contact with an upper roller surface and a lower roller surface of the hemming roller, and is installed at a front end of a working rod of the drive cylinder through a bracket.

8. The cleaning device of claim 1, wherein the roller rotation unit includes:

a servo motor fixedly installed on the upper surface of the support frame, and a rotation member connected to a drive shaft of the servo motor, and configured to rotate while being in contact with a bottom surface of the hemming roller.

9. The cleaning device of claim 8, wherein the rotation member includes a rubber roller configured to:

cause a friction to the bottom surface of the hemming roller, and rotate the hemming roller.

10. The cleaning device of claim 1, further comprising:

a first drive cylinder fixedly installed on the support frame and configured to apply a forward and backward operation force to the scraper.

11. The cleaning device of claim 10, wherein the scraper has a scraping surface that is in close contact with a roller surface of the hemming roller, and is installed at a front end of a working rod of the first drive cylinder through a bracket.

12. A cleaning device for a hemming roller unit having a plurality of preliminary hemming rollers and a main hemming roller, the cleaning device comprising:

a support frame installed on a floor of a workshop in a vertical direction;

a roller detection sensor installed on the support frame and configured to detect a presence or an absence of a preliminary hemming roller of the plurality of preliminary hemming rollers and the main hemming roller when the hemming roller unit, which is mounted on a hemming robot, moves to a predetermined position by the hemming robot;

a roller rotation unit installed on an upper surface of the support frame and configured to rotate the main hemming roller through a first drive unit;

a scraper installed on the support frame and configured to move back and forth by a second drive unit, while the scraper is facing the roller rotation unit in close contact with a roller surface of the main hemming roller, and removing foreign substances on the roller surface;

a felt cushion installed on the upper surface of the support frame and configured to:

move back and forth between the roller rotation unit and the scraper by a third drive unit, and remove a residual foreign substance on the roller surface of the main hemming roller; and a cleaning oil spraying unit configured to spray cleaning oil toward the scraper and felt cushion, respectively.

13. The cleaning device for hemming roller of claim 12, wherein the roller detection sensor includes:

a sensor body installed on a sensor bracket provided on the upper surface of the support frame, a switch lever rotatably installed in the vertical direction through a spring on the sensor body, and a touch roller rotatably installed at an end of the switch lever and in contact with the main hemming roller and configured to rotate.

14. The cleaning device for hemming roller of claim 12, further comprising:

a cleaning oil receiving portion installed on the upper surface of the support frame and configured to collect the cleaning oil sprayed toward the scraper and felt cushion.

15. The cleaning device for hemming roller of claim 12, wherein the scraper is provided with a steel block having a scraping surface contacting the roller surface of the main hemming roller.

16. The cleaning device for hemming roller of claim 12, wherein the felt cushion is made of a woolen fiber having a cushion surface in close contact with an upper roller surface and a lower roller surface of the hemming roller.

17. The cleaning device for hemming roller of claim 12, wherein the cleaning oil spraying unit includes:

a cleaning oil storage tank installed on the support frame, a cleaning oil supply pump connected to the cleaning oil storage tank and configured to discharge cleaning oil stored in the cleaning oil storage tank through a nozzle line, and a nozzle member fixed to each of the scraper and the felt cushion, connected to the nozzle line, and configured to spray the cleaning oil to the scraper and the felt cushion.

* * * * *